US007606507B2

(12) United States Patent
Soshiroda

(10) Patent No.: US 7,606,507 B2
(45) Date of Patent: Oct. 20, 2009

(54) IMAGE FORMING APPARATUS

(75) Inventor: Hiroshi Soshiroda, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 217 days.

(21) Appl. No.: 11/812,917

(22) Filed: Jun. 22, 2007

(65) Prior Publication Data

US 2008/0019717 A1 Jan. 24, 2008

(30) Foreign Application Priority Data

Jul. 18, 2006 (JP) ..... 2006-195848

(51) Int. Cl.
*G03G 15/14* (2006.01)

(52) U.S. Cl. ..... 399/66; 399/316; 399/45; 399/121; 399/302; 399/389; 399/397; 399/388

(58) Field of Classification Search ..... 399/45, 399/66, 302, 308, 313, 388, 389, 397, 121, 399/316

See application file for complete search history.

(56) References Cited

U.S. PATENT DOCUMENTS 6,002,891 A * 12/1999 Shin ..... 399/45
6,349,192 B1 * 2/2002 Yoshino et al. ..... 399/302
7,130,568 B2 * 10/2006 Mochizuki ..... 399/298
2008/0304878 A1 * 12/2008 Matayoshi ..... 399/302

FOREIGN PATENT DOCUMENTS

| | | |
|---|---|---|
| JP | 5-61365 | 3/1993 |
| JP | 5-127458 | 5/1993 |
| JP | 8-146860 | 6/1996 |
| JP | 2002-156839 | 5/2002 |
| JP | 2005-258288 | 9/2005 |

* cited by examiner

*Primary Examiner*—David M Gray
*Assistant Examiner*—G. M. Hyder
(74) *Attorney, Agent, or Firm*—Finnegan, Henderson, Farabow, Garrett & Dunner, L.L.P.

(57) ABSTRACT

An image forming apparatus includes: a primary transfer section which transfers a toner image formed in an image forming section onto an intermediate transfer belt; a back-up roller arranged on an inner periphery side of the intermediate transfer belt; a secondary transfer roller that is in pressure contact with the back-up roller through the intermediate transfer belt and transfers the toner image from the intermediate transfer belt onto a transfer material while conveying the transfer material; a moving mechanism which moves a position where the secondary transfer roller is in contact with the back-up roller through the intermediate transfer belt; and a controller which controls the moving mechanism based on information relating to a thickness of the transfer material obtained by a thickness information obtaining section.

19 Claims, 4 Drawing Sheets

IMAGE FORMING APPARATUS

This application is based on Japanese Patent Application No. 2006-195848 filed on Jul. 18, 2006, which is incorporated hereinto by reference.

BACKGROUND OF THE INVENTION

This invention relates to an image forming apparatus which uses an electrophotographic system, such as a copier, a printer, and a facsimile, and which has functions thereof. In particular, this invention relates to an image forming apparatus in which the toner image that is carried on the surface of the image carrier of a photoreceptor or the like is caused to contact and transfer to a transfer material by a transfer section, and the plurality of color toner images formed on an intermediate transfer member are superposed and transferred to the transfer material.

Examples of known image forming apparatuses in which a toner image that is carried on the surface of a toner image carrier and the like is caused to contact and transfer to the transfer material using a transfer section are described in the following documents.

Unexamined Japanese Patent Application Publication No. 05-61365 is an image forming apparatus that has a means for bringing the recording sheet in close contact with the belt-shaped photoreceptor at a position immediately before the transfer position.

Unexamined Japanese Patent Application Publication No. 08-146860 is an image forming apparatus which comprises contact varying means for changing contact pressure applied to the image carrier, which is the transfer roller, in accordance with the components of the toner inside the process cartridge and the size of the transfer material.

Unexamined Japanese Patent Application Publication No. 2002-156839 is an image forming apparatus which comprises a detection section for determining a member to be transferred by the transfer section that has a back-up roller and an intermediate transfer member; and a controller for controlling the pressing pressure of the member to be transferred using the backup roller in accordance with type of member to be transferred that was determined by the detection section.

Unexamined Japanese Patent Application Publication No. 2005-258288 is an image forming apparatus which obtains the sheet type data for transfer material from the sheet type detection section and based on this data, the transfer time for the transfer material and the contact conditions for the image carrier such as the length of the transfer nip width and timing of transfer material arrival are varied.

Unexamined Japanese Patent Application Publication No. 05-127458 is an image forming apparatus in which the contact positions of the image carrier and the transfer member comprise a first position at the time of the first surface printing of the transfer material; and a second position at the time of the second surface printing which is different from the first position, and by changing the first and second position when printing of the both the first surface and the second surface is performed, the transfer material ejection angle which is formed between the image carrier and the contact and transfer member is changed.

In the prior art technology disclosed in Unexamined Japanese Patent Application Publication Nos. 05-61365, 08-146860, and 2002-156839, and 2005-258288, the contact position where the transfer member contacts the image carrier is fixed, and the contact pressure in the transfer section and the transfer nip width are variable and are set to prescribed values with reference to sheet feeding performance, separation performance, transfer performance and the like of the transfer material.

However, depending on whether the transfer material is a thick sheet or thin sheet, the transfer material that is ejected from the transfer section may have reduced image quality due to separation failure, sliding contact on the eject guide plate in the vicinity of the rear end of the transfer material, flipping of the rear end of the transfer material and the like.

In the prior art technology disclosed in Unexamined Japanese Patent Application Publication No. 05-127458, the contact positions of the image carrier (photoreceptor drum) and the transfer member (transfer roller) comprise a first position at the time of first surface printing of the transfer material and a second position at the time of second surface printing which different from the first position, and this solves the problems occurring when transfer materials are conveyed at the time of printing of both surfaces. In addition, a means for varying entry of the transfer material into the transfer section and ejection of the transfer material from the transfer section may be considered.

One aspect of the present invention is an image forming apparatus including: an image forming section for forming a toner image on a photoreceptor; a primary transfer section for transferring the toner image formed in the image forming section to an intermediate transfer belt; a back-up roller that is arranged at the inner periphery side of the intermediate transfer belt; a secondary transfer roller that is in pressure contact with the back-up roller via the intermediate transfer belt and transfers the toner image from the intermediate transfer belt onto the transfer material while conveying the transfer material; a thickness information obtaining section which obtains information relating to the thickness of the transfer material; a moving mechanism which moves a position where the secondary transfer roller is in contact with the back-up roller via the intermediate transfer belt; and a controller which controls the moving mechanism based on the information relating to the thickness of the transfer material obtained by the thickness information obtaining section.

Another aspect of the present information is an image forming apparatus including: an image forming section for forming a toner image on a photoreceptor belt; a back-up roller that is arranged at the inner periphery side of the photoreceptor belt; a transfer roller that is in pressure contact with the back-up roller via the photoreceptor belt and transfers the toner image from the photoreceptor belt to the transfer material while conveying the transfer material; a thickness information obtaining section which obtains information relating to the thickness of the transfer material; a moving mechanism which moves a position where the transfer roller is in contact with the back-up roller via the photoreceptor belt; and a controller which controls the moving mechanism based on the information relating to the thickness of the transfer material obtained by the thickness information obtaining section.

Still another aspect of the present invention is an image forming apparatus including: an image forming section for forming a toner image on a photoreceptor; a primary transfer section for transferring the toner image formed in the image forming section to an intermediate transfer drum; a secondary transfer roller that is in pressure contact with the intermediate transfer drum and transfers the toner image from the intermediate transfer drum to the transfer material while conveying the transfer material; a thickness information obtaining section which obtains information relating to the thickness of the transfer material; a moving mechanism which moves a position where the secondary transfer roller is in contact with the intermediate transfer drum; and a controller which controls the moving mechanism based on the information relating to the thickness of the transfer material obtained by the thickness information obtaining section.

BRIEF DESCRIPTION OF THE DRAWINGS

Each of FIGS. 1(*a*) and 1(*b*) is a cross-sectional view of transfer section where the image carrier contacts the transfer roller.

DETAILED DESCRIPTION OF THE PREFERRED EMBODIMENT

The present invention will be described using this embodiment, but the present invention is not to be limited thereby.

Figure 1:
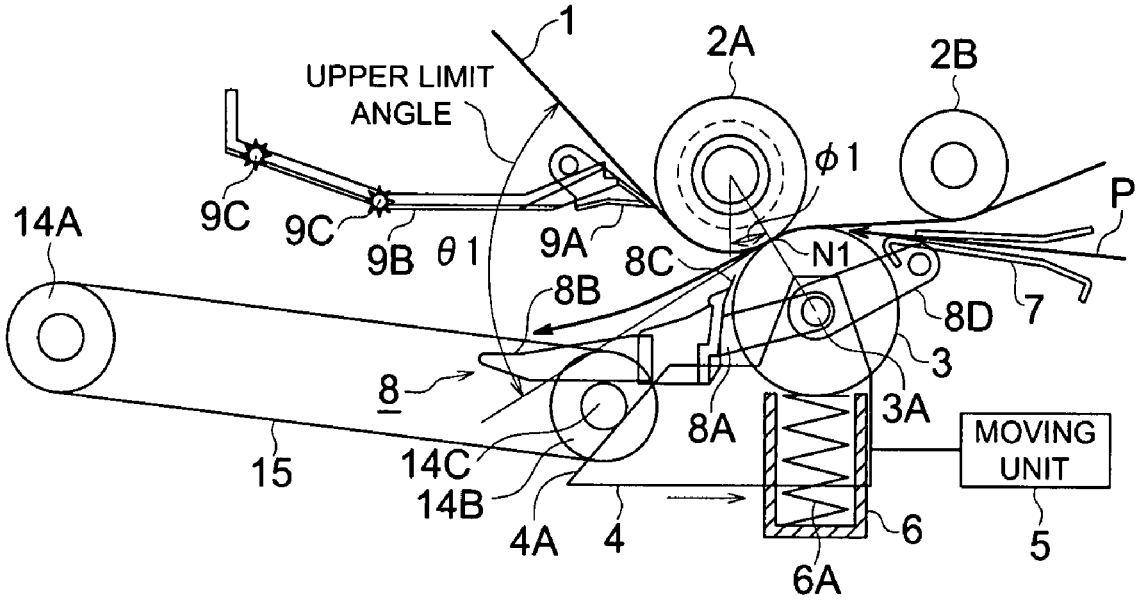
Figure 1:
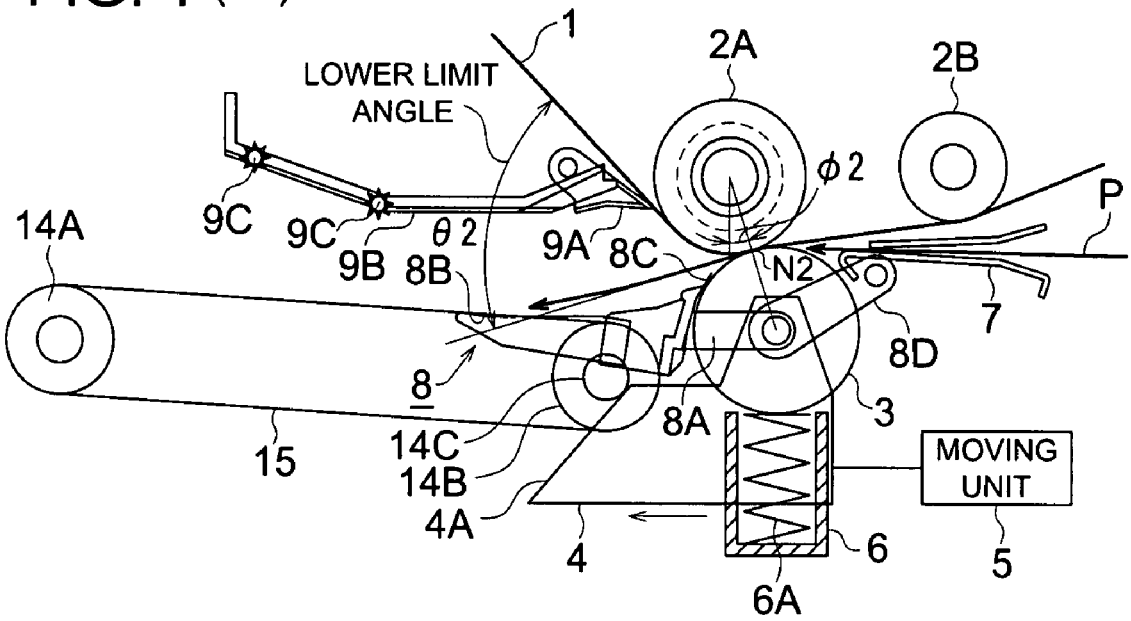

FIGS. 1(*a*) and 1(*b*) are cross-sectional views showing the transfer section related to this invention in which the image carrier 1 and the transfer roller 3 contact each other.

FIG. 1(*a*) shows thick transfer material P or normal transfer material P being conveyed to the transfer section and then ejected. FIG. 1(*b*) shows the thick transfer material P being conveyed to the transfer section and then ejected.

The belt-shaped photoreceptor or the intermediate transfer member which is the image carrier 1 is entrained about back-up roller 2A, support roller 2B and plural roller groups (See FIG. 2) and rotated thereby. The transfer roller (secondary transfer roller) 3 presses the back-up roller 2A via the image carrier 1.

The slide member 4 is anchored at both ends of the rotation shaft 3A of the transfer roller 3. The slide member 4 is moved horizontally in the direction of the arrow shown in the drawing by the moving unit (also referred to as moving mechanism) 5. The spring 6A of the pressing unit 6 that is fixed to the slide member 4 presses the transfer roller 3.

The entry guide member 7 is arranged at the upstream side in the transfer member conveyance direction of the transfer nip portion (pressure contact position) N1 (or N2) where the back-up roller 2A and the transfer roller 3 come in contact through the image carrier 1. The eject guide member 8, the drive roller 14A, and the conveyance belt 15 which winds the driven rollers 14B are arranged at the downstream side in the transfer member conveyance direction of the transfer nip portion N1 (or N2).

The incline surface 4A of the slide member 4 contacts the rotation shaft 14C of the driven roller 14B and the driven roller 14B oscillates around the rotation shaft of the drive roller 14A to thereby oscillate the conveyance belt 15.

An ejection guide member 8 is connected to one end of the slide member 4. The ejection guide member 8 has a connection lever 8A, a transfer member guide surface 8B and a negative electric member 8C, and is supported so as to oscillate around the rotation shaft 3A.

The arm 8D is connected to the other end of the slide member 4. The tip of the arm 8D is connected to the entry guide member 7. The entry guide member 7 is moved via the arm 8D along with the movement of the slide member 4.

A separation claw 9A, an upper guide plate 9B, and a toothed wheel 9C are disposed above the conveyor belt 15 at the transfer material ejection side of the transfer section.

When the thick transfer material P or the normal transfer material P is conveyed and ejected, the slide member 4 moves in the direction of the arrow shown in FIG. 1(*a*) and the rotation shaft 3A of the transfer roller stops at the first angle $\phi$1 position with respect to the vertical line. The ejection guide member 8 then oscillates in the anticlockwise direction shown in the drawing around the rotation shaft 3A and the tip of the transfer member guide surface 8B is positioned below the upper surface of the conveyance belt 15.

With the surface of the ejection side of the image carrier 1 as a reference, the transfer material ejection upper limit angle $\theta$1 which forms the common tangent at the transfer nip portion N1 between the back-up roller 2A and the transfer roller 3 is larger than the foregoing transfer material ejection upper limit angle $\theta$2. Thus, the transfer material P that is ejected from the transfer nip portion N1 11 8174 moves downward along the common tangent and is loaded on the conveyance belt in which the driven roller 14B side is lowered and thereby conveyed. In addition, the entry guide member 7 also moves relative to the movement of the transfer roller 3 and maintains a prescribed interval.

When the thick transfer material P is conveyed to the transfer section, the slide member 4 moves in the direction of the arrow shown in FIG. 1(*b*) and the rotation shaft 3A of the transfer roller 3 stops at the second angle $\phi$2 which is smaller than the first angle $\phi$1 with respect to the vertical line. In this state, the ejection guide member 8 oscillates in the clockwise direction as shown, around the rotation axle 3A and the tip of the transfer guide surface 8B is positioned in the vicinity of the upper surface of the conveyance belt 15.

In this state, with the surface of the ejection side of the image carrier 1 as a reference, the transfer material ejection lower limit angle $\theta$2 which forms the common tangent at the transfer nip portion N2 between the back-up roller 2A and the transfer roller 3 is smaller than the foregoing transfer material ejection lower limit angle $\theta$1. Thus, the transfer material P that is ejected from the transfer nip portion N2 moves downward gently along the common tangent and is loaded on the conveyance belt in which the driven roller 14B side ascends and thereby conveyed. In addition, the entry guide member 7 also moves relative to the movement of the transfer roller 3 and maintains a prescribed interval.

Figure 2:
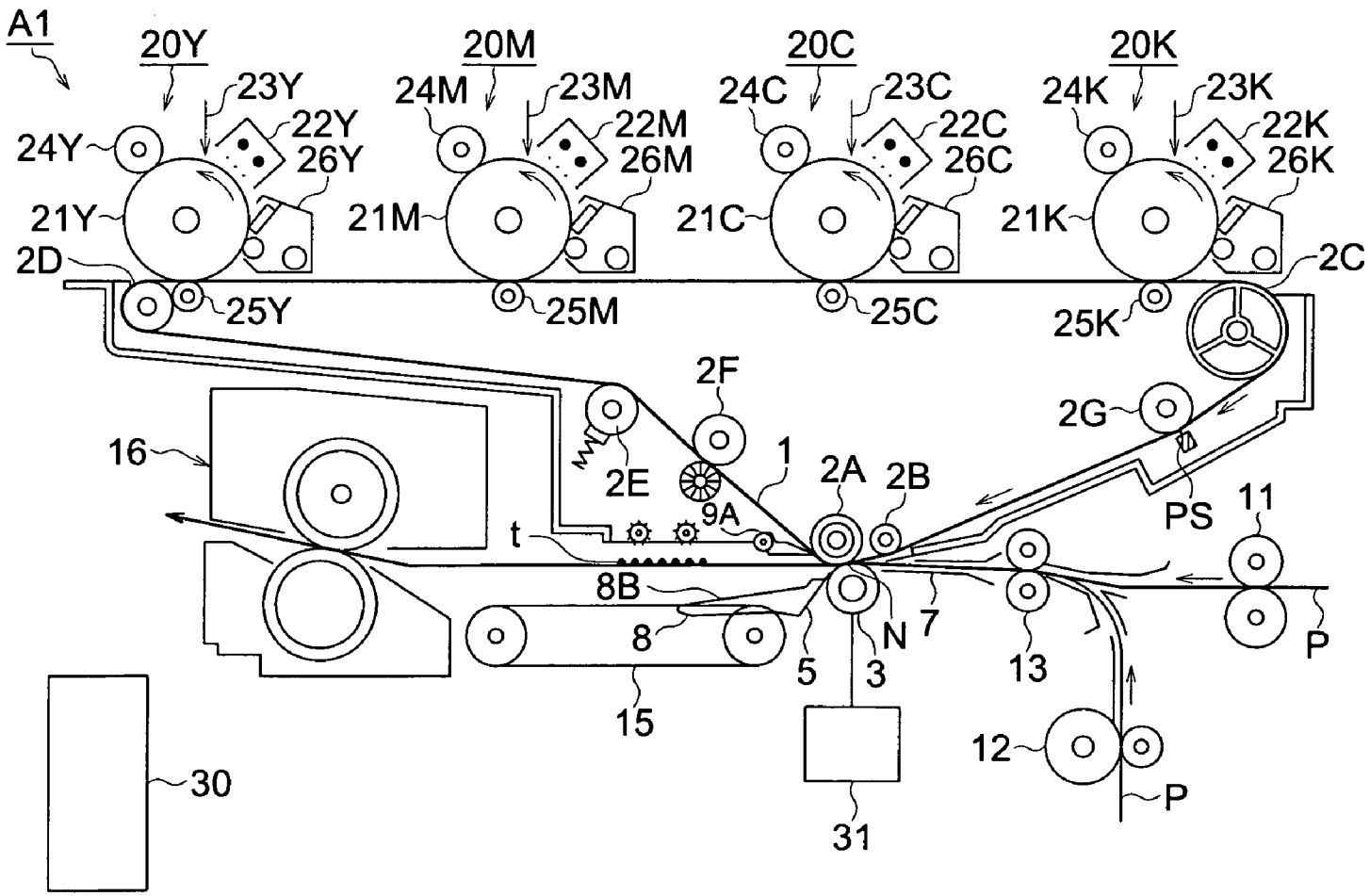
FIG. 2 is a cross-sectional view of the main parts of the image forming apparatus.

FIG. 2 is cross-sectional view showing the main parts of the image forming apparatus A1 according to an embodiment of the present invention.

The image forming apparatus A is called a tandem type color image forming apparatus and thus has plural image forming sections 20Y, 20M, 20C, 20K; an intermediate transfer unit formed from a belt-shaped image carrier (intermediate transfer member) 1; primary transfer rollers 25Y, 25M, 25C, and 25K, and transfer roller (secondary transfer roller 3); a fixing unit 16; and a sheet feeding unit.

The document loaded on the document tray is scanned imagewise and exposed by the optical system of the document image imagewise scanning and exposing device of the image reading device and then read by a line image sensor. The analog signal that was photoelectrically converted by the line image sensor is subjected to analog processing, A/D conversion, shading correction and image compression processing in the image processing section and then input into the imagewise exposure units 23Y, 23M, 23C, 23K.

The image forming unit 20Y which forms the yellow (Y) images has a charging unit 22Y, an exposing unit 23Y, a developing unit 24Y, and a cleaning unit 26Y around the image carrier 21.

The image forming unit 20M which forms the magenta (M) images has an image carrier 21M, a charging unit 22M, an exposing unit 23M, a developing unit 24M, and a cleaning unit 26M.

The image forming unit 20C which forms the cyan (C) images has an image carrier 21C, a charging unit 22C, an exposing unit 23C, a developing unit 24C, and a cleaning unit 26C.

The image forming unit 20K which forms the black (K) images has an image carrier 21K, a charging unit 22K, an exposing unit 23K, a developing unit 24K, and a cleaning unit 26K.

The charging unit 22Y and the exposing unit 23Y, the charging unit 22M and the exposing unit 23M, charging unit 22C and the exposing unit 23C, and the charging unit 22K and the exposing unit 23K constitutes the latent image forming unit.

Known substances such as OPC photoreceptors or amorphous silicon photoreceptors may be used as the image carriers 21Y, 21M, 21C, 21K but OPC photoreceptors are preferable, and in particular a negatively charged OPC photoreceptor is favorable, and in this embodiment a negatively charged OPC is used.

Corona discharging units such as scorotron, corotron and the like may be used as the charging units 22Y, 22M, 22C, and 22K, but a scorotron discharging unit is preferable.

Light emitting elements which emit light in accordance with image data such as lasers, LED arrays and the like may be used as the exposing units 23Y, 23M, 23C and 23K.

The belt-shaped intermediate transfer member 1 is semiconductive and is wound by the roller 2G which opposes the back-up roller 2A, the support roller 2B, the drive roller 2C, the driven roller 2D, the tension roller 2E and the cleaning roller 2F and is supported so that circulation movement is possible. In this embodiment, the intermediate transfer member 1 is supported horizontally between the drive roller 2C and the driven roller 2D.

The toner images "t" of each color formed by the image forming units 20Y, 20M, 20C, and 20K are sequentially transferred by the primary transfer rollers 25Y, 25M, 25C and 25K on the intermediate transfer body which rotates, and the toner image "t" which is a composite color image is formed.

The transfer material P that is stored inside the sheet feeding cassette of the sheet feeding apparatus is fed by the sheet feed unit (first sheet section) and it passes via the sheet feed roller 12, the registration roller (second sheet section) 13 to the entry guide member 7 and then is conveyed to the transfer nip portion N in which the transfer roller 3 of the secondary transfer unit and the back-up roller 2A contact each other via the intermediate transfer member 1, and the toner image t is transferred onto the transfer material P (secondary transfer).

Alternatively, the transfer material P that is sent in from a manual sheet feeding unit may be conveyed to the transfer nip portion N via the sheet feeding roller 11 and the registration roller 13.

The transfer material P onto which the color image has been transferred passes above the surface of the transfer material guide 8B of the ejection guide member 8 and is conveyed by the conveyance belt 15 and heat and pressure are applied at the fixing unit 16 and the residual toner is removed from the intermediate transfer body 1 for which the transfer material P is separated by curvature separation and by the separation claw 9A, by the cleaning roller 2F.

When the information relating to the thickness of the transfer material P from the thickness information obtaining section is obtained at the image forming apparatus A1, the controller 30 drives the moving unit (also referred to as moving mechanism) 31 such that the position where the secondary transfer roller 3 contacts the back-up roller 2A is moved.

Figure 3:
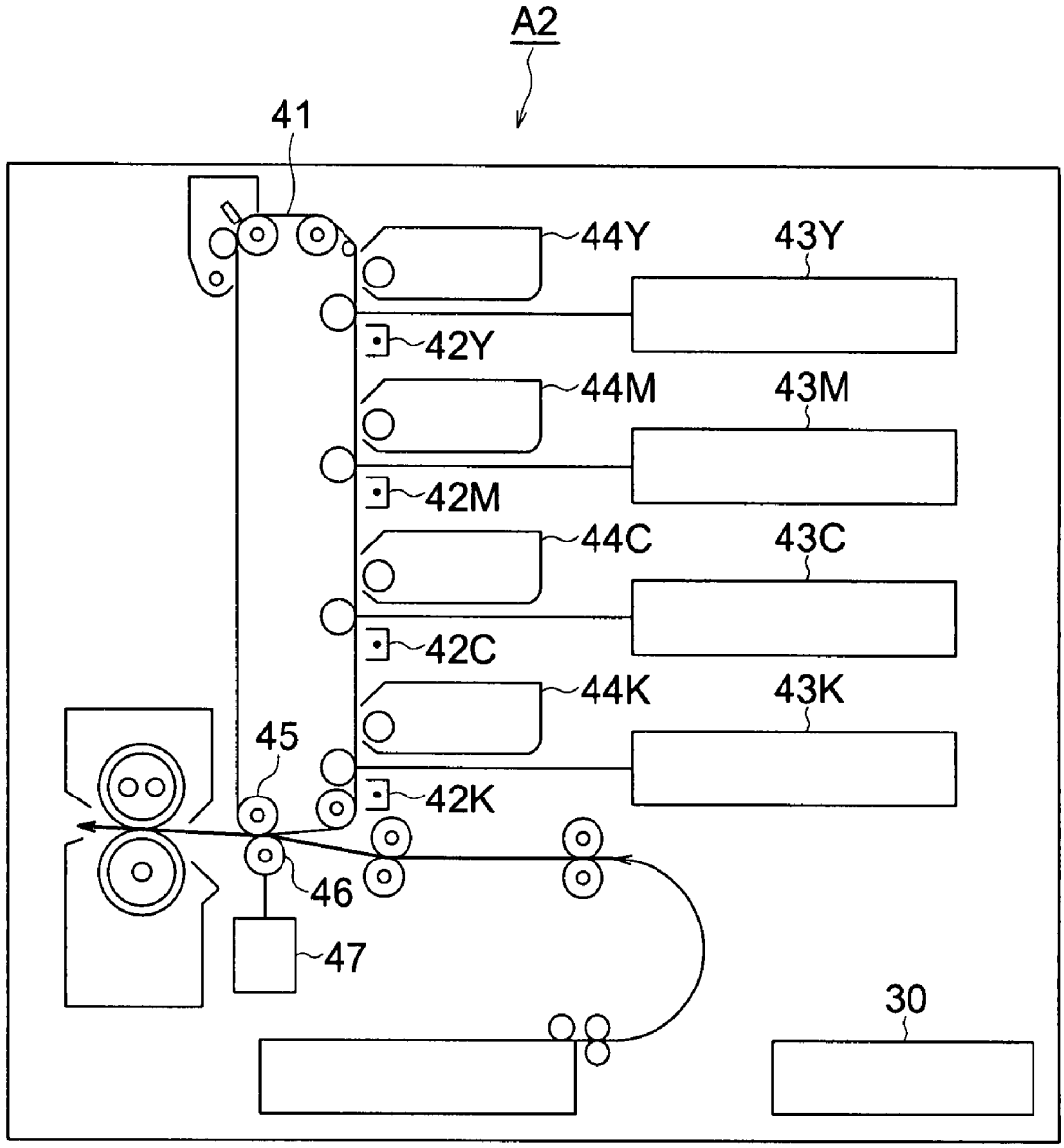
FIG. 3 is a cross-sectional view of the main parts of the image forming apparatus relating to another embodiment of this invention.

FIG. 3 is a cross-sectional view showing the main parts of the image forming apparatus A2 relating to another embodiment of this invention.

The plural image forming sections in which toner images are formed on the image forming surfaces of photoreceptor belt 41 comprise the charging units 42Y, 42M, 42C, 42K; the imagewise exposure units 43Y, 43M, 43C, 43K; the developing units 44Y, 44M, 44C, 44K and the like.

The image forming apparatus A2 has transfer rollers 46 which pressure-contact the back-up rollers arranged at the inner periphery side of the photoreceptor belt 41 via the photoreceptor belt 41, and the toner images formed on the photoreceptor belt 41 are transferred to the transfer material P and then the transfer material P is ejected.

When the information relating to the thickness of the transfer material P from the thickness information obtaining section is obtained at the image forming apparatus A2, the controller 30 drives the moving unit (also referred to as moving mechanism) 47 such that the position where the secondary transfer roller 46 contacts the back-up roller 45 is moved.

Figure 4:
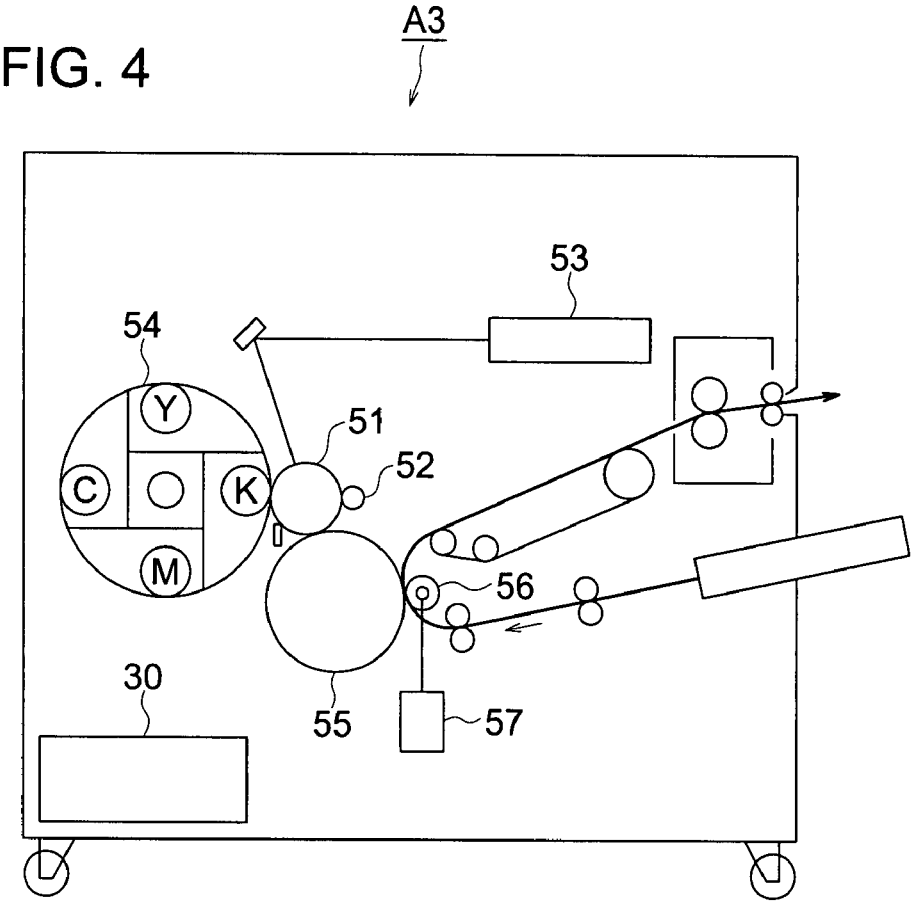
FIG. 4 is a cross-sectional view showing the main parts of the image forming apparatus relating to yet another embodiment of this invention.

FIG. 4 is a cross-sectional view showing the main parts of the image forming apparatus A3 relating to yet another embodiment of this invention.

The image forming section in which toner images are formed on the image forming surfaces of photoreceptor belt 51 is constituted of the charging unit 52Y, the imagewise exposure unit 53Y, the rotating developing unit 54Y and the like.

The image forming apparatus A3 has a secondary transfer roller 56 which pressure-contacts the intermediate transfer drum 55 which contacts the outer periphery of the photoreceptor drum 51 and the toner images formed on the intermediate transfer drum 55 are transferred to the transfer material P and then the transfer material P is ejected.

When the information relating to the thickness of the transfer material P from the thickness information obtaining section is obtained at the image forming apparatus A3, the controller 30 drives the moving unit (also referred to as moving mechanism) 57 such that the position where the secondary transfer roller 56 contacts the intermediate transfer drum 55 is moved.

Figure 5:
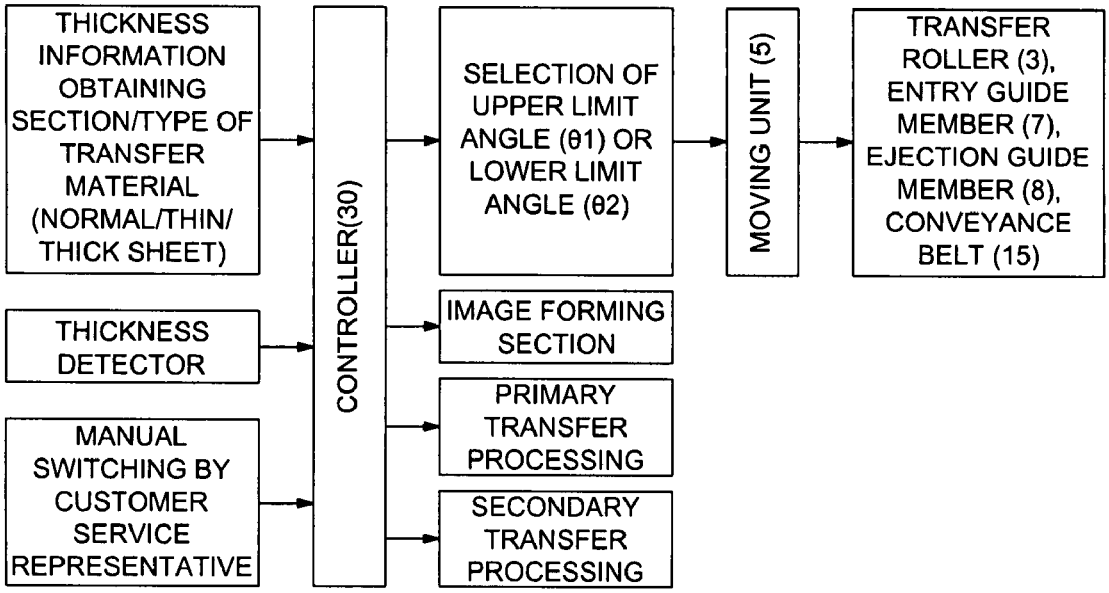
FIG. 5 is a block diagram showing switch control of the transfer section.

FIG. 5 is a block diagram showing switch control of the transfer section.

Angle switching of the transfer section which is constituted of the transfer roller 3, the entry guide member 7, the ejection guide member 8, and the conveyance belt 15 is conducted by one of the following structures.

1. In the inputting section of the operation section of the image forming apparatus A, the thickness information obtaining unit (sheet type information) is selected, or in other words, a selection is made from normal sheet, thin sheet and thick sheet. The controller 30 selects one of the transfer material ejection upper limit angle θ1 or transfer material ejection lower limit angle θ2 based on this sheet type information. Thin sheet herein for example, indicates a sheet with a basis weight of 50-59 g/m$^2$, while normal sheet is a sheet with a basis weight of 60-90 g/m$^2$ and thick sheet is a sheet with a basis weight of 91-200 g/m$^2$.

That is to say, in the case where the sheet type for the transfer material P is normal sheet or thin sheet, the transfer roller 3 is moved to a prescribed position by the moving unit 5 so as to have the transfer material ejection upper limit angle θ1 shown in FIG. 1(*a*). Along with this movement, the entry guide member 7, the ejection guide member 8, and the conveyance belt 15 are swung and moved respectively to a suitable position. On the other hand, in the case where the sheet type for the transfer material P is thick sheet, the transfer roller 3 is moved by the moving unit 5 to a prescribed position so as to have the transfer material ejection lower limit angle θ2 shown in FIG. 1(*b*). Along with this movement, the entry guide member 7, the ejection guide member 8, and the conveyance belt 15 are swung and moved respectively to a suitable position. It is to be noted that position where the transfer material ejection angle is the upper limit value of θ1 is the home position, and when thick sheet is selected, controlling movement of the transfer roller 3 lightens the burden of control such that the transfer material ejection angle is the lower limit of θ2.

2. The thickness of the transfer material P that is fed from the sheet feeding unit is detected by the thickness detector 70, and a determination is made as to whether the sheet type for the transfer material is normal sheet, thin sheet or thick sheet. As is the case in 1 above, the entry guide member 7, the transfer roller 3, the ejection guide member 8 and the conveyance belt 15 are moved by the driving means 5 such that transfer material ejection upper limit angle θ1 or the transfer material ejection lower limit angle θ2 is achieved.

The thickness detector may have a structure in which an actuator is caused to protrude into the curved plain sheet section for example, and the load (sheet stiffness) received from the transfer material that passes through the actuator is measured by the load detection sensor and the thickness is thereby detected. Alternatively, the structure may be such that the roller shaft of the conveyance roller is provided such that displacement is possible, and the displacement amount of the roller shaft of the conveyance roller when the transfer material passes through is measured by a displacement sensor and the thickness is thereby detected. Furthermore, a transmission type photosensor may be provided in the conveyance path and the transmission rate of the light from the transfer material is measured using the transmission type photosensor and the thickness is thereby detected.

3. The customer service representative moves and thereby sets the entry guide member 7, the transfer roller 3, the ejection guide member 8 and the conveyance belt 15 in accordance with the type of transfer material P to be used that is loaded in the image forming apparatus used by the user in the market such that transfer material ejection upper limit angle θ1 or the transfer material ejection lower limit angle θ2 is achieved.

The switching of the transfer material ejection upper limit angle θ1 and the transfer material ejection lower limit angle θ2 is controlled so as to be restricted by specific conditions. That is to say, even if the sheet type of the transfer material P is changed during a series of image forming processes, angle switching for the transfer material ejection upper limit angle θ1 and the transfer material ejection lower limit angle θ2 does not change. For example, at the transfer nip portion N1 (or N2), during conveyance of the transfer material (P), even if insert sheets of a different sheet type are inserted and conveyed, angle switching does not occur and control is performed such that conveyance continues at the ejection angle that was initially set.

In addition, the image forming processes are controlled such that primary transfer or the like is restricted during the operation of switching to the position where the roller 3 is pressure-contacted with the intermediate transfer member 1. The vibration generated during the pressure-contact position switching operation of the transfer roller 3 is transmitted to the intermediate transfer member 1 and the possibility arises that image disturbance may occur in the primary transfer section. In order to prevent this, the image forming processes are controlled such that primary transfer is restricted and after the switching operation is complete, the image forming processes start.

The following effects are obtained by the image forming apparatus of this embodiment.

1. In the image forming apparatus comprising a photoreceptor, an image forming section, an intermediate transfer belt, a primary transfer section, and a secondary transfer roller, when a thick transfer material is ejected from the transfer section 9, transfer material staining generated by friction due to sliding on the ejection guide plate in the vicinity of the transfer material rear end or flipping of the rear end of the transfer material or the like, is prevented by moving the position where the secondary transfer roller contacts the back-up roller.

2. In the image forming apparatus comprising a photoreceptor belt, an image forming section and a transfer roller, when a thick transfer material is ejected from the transfer section, transfer material staining generated by friction due to sliding on the ejection guide plate in the vicinity of the transfer material rear end or flipping of the rear end of the transfer material or the like, is prevented by moving the position where the transfer roller contacts the back-up roller.

3. In the image forming apparatus comprising a photoreceptor, an image forming section, an intermediate transfer drum, a primary transfer section, and a secondary transfer roller, thick transfer material transfer displacement and rear end transfer defects are prevented.

What is claimed is:

1. An image forming apparatus comprising:

(a) an image forming section which forms a toner image on a photoreceptor;

(b) a primary transfer section which transfers the toner image formed in the image forming section onto an intermediate transfer belt;

(c) a back-up roller arranged on an inner periphery side of the intermediate transfer belt;

(d) a secondary transfer roller that is in pressure contact with the back-up roller through the intermediate transfer belt and transfers the toner image from the intermediate transfer belt onto a transfer material while conveying the transfer material;

(e) a thickness information obtaining section which obtains information relating to a thickness of the transfer material;

(f) a moving mechanism which moves a position where the secondary transfer roller is in contact with the back-up roller through the intermediate transfer belt; and (g) a controller which controls the moving mechanism based on the information relating to the thickness of the transfer material obtained by the thickness information obtaining section.

2. The image forming apparatus of claim 1, wherein the controller controls the moving mechanism so that when the thickness of the transfer material is equal to or less than a reference value, the position where the secondary transfer roller is in contact with the back-up roller through the intermediate transfer belt, is set to a reference position, and when the thickness of the transfer material is more than the reference value, the position where the secondary transfer roller is in contact with the back-up roller through the intermediate transfer belt, is moved from the reference position toward an ejection direction of the transfer material.

3. The image forming apparatus of claim 1, wherein the controller controls the moving mechanism so that the following expression is satisfied:

$$\theta 1 > \theta 2$$

where θ1 represents a transfer material ejection angle formed by a tangential line at a transfer nip portion between the secondary transfer roller and the intermediate transfer belt, and a surface of the intermediate transfer belt on an ejection side of the transfer nip portion, when the thickness of the transfer material is equal to or less than a reference value, and θ2 represents the transfer material ejection angle when the thickness of the transfer material is more than the reference value.

4. The image forming apparatus of claim 1, further comprising a conveyance belt disposed downstream of a transfer nip portion between the secondary transfer roller and the intermediate transfer belt in a conveyance direction of the transfer material, wherein an end portion of the conveyance belt in the vicinity of the secondary transfer roller oscillates according to movement of the secondary transfer roller.

5. The image forming apparatus of claim 1, further comprising an entry guide member disposed upstream of a transfer nip portion between the secondary transfer roller and the intermediate transfer belt in a conveyance direction of the transfer material, wherein the entry guide member is moved according to movement of the secondary transfer roller.

6. The image forming apparatus of claim 1, wherein the position of the secondary transfer roller is not moved while a series of image forming processing operation is carried out.

7. The image forming apparatus of claim 1, wherein an image forming processing operation is not carried out while the position where the secondary transfer roller is in contact with the back-up roller through the intermediate transfer belt, is switched over.

8. The image forming apparatus of claim 1, further comprising a thickness detector which detects a thickness of the transfer material, wherein the thickness information obtaining section obtains a detection result by the thickness detector.

9. An image forming apparatus comprising:

(a) an image forming section which forms a toner image on a photoreceptor belt;

(b) a back-up roller arranged on an inner periphery side of the photoreceptor belt;

(c) a transfer roller that is in pressure contact with the back-up roller through the photoreceptor belt and transfers the toner image from the photoreceptor belt onto the transfer material while conveying a transfer material;

(d) a thickness information obtaining section which obtains information relating to a thickness of the transfer material;

(e) a moving mechanism which moves a position where the transfer roller is in contact with the back-up roller through the photoreceptor belt; and (f) a controller which controls the moving mechanism based on the information relating to the thickness of the transfer material obtained by the thickness information obtaining section.

10. The image forming apparatus of claim 9, wherein the controller controls the moving mechanism so that when the thickness of the transfer material is equal to or less than a reference value, the position where the transfer roller is in contact with the back-up roller through the photoreceptor belt, is set to a reference position, and when the thickness of the transfer material is more than the reference value, the position where the transfer roller is in contact with the back-up roller through the photoreceptor belt, is moved from the reference position toward an ejection direction of the transfer material.

11. The image forming apparatus of claim 9, wherein the controller controls the moving mechanism so that the following expression is satisfied:

$$\theta 1 > \theta 2$$

where θ1 represents a transfer material ejection angle formed by a tangential line at a transfer nip portion between the transfer roller and the photoreceptor belt, and a surface of the photoreceptor belt on an ejection side of the transfer nip portion, when the thickness of the transfer material is equal to or less than a reference value, and θ2 represents the transfer material ejection angle when the thickness of the transfer material is more than the reference value.

12. The image forming apparatus of claim 9, wherein the position of the transfer roller is not moved while a series of image forming processing operation is carried out.

13. The image forming apparatus of claim 9, wherein an image forming processing operation is not carried out while the position where the transfer roller is in contact with the back-up roller through the intermediate transfer belt, is switched over.

14. The image forming apparatus of claim 9, further comprising a thickness detector which detects a thickness of the transfer material, wherein the thickness information obtaining section obtains a detection result by the thickness detector.

15. An image forming apparatus comprising:

(a) an image forming section which forms a toner image on a photoreceptor;

(b) a primary transfer section which transfers the toner image formed in the image forming section onto an intermediate transfer drum;

(c) a secondary transfer roller that is in pressure contact with the intermediate transfer drum and transfers the toner image from the intermediate transfer drum onto a transfer material while conveying the transfer material;

(d) a thickness information obtaining section which obtains information relating to a thickness of the transfer material;

(e) a moving mechanism which moves a position where the secondary transfer roller is in contact with the intermediate transfer drum; and (f) a controller which controls the moving mechanism based on the information relating to the thickness of the transfer material obtained by the thickness information obtaining section.

16. The image forming apparatus of claim 15, wherein the controller controls the moving mechanism so that when the thickness of the transfer material is equal to or less than a reference value, the position where the secondary transfer roller is in contact with the intermediate transfer drum, is set to a reference position, and when the thickness of the transfer material is more than the reference value, the position where the secondary transfer roller is in contact with the intermediate transfer drum, is moved from the reference position toward an ejection direction of the transfer material.

17. The image forming apparatus of claim 15, wherein the position of the secondary transfer roller is not moved while a series of image forming processing operation is carried out.

18. The image forming apparatus of claim 15, wherein an image forming processing operation is not carried out while the position where the secondary transfer roller is in contact with the intermediate transfer drum, is switched over.

19. The image forming apparatus of claim 15, further comprising a thickness detector which detects a thickness of the transfer material, wherein the thickness information obtaining section obtains a detection result by the thickness detector.

* * * * *